United States Patent [19]

Chauvier et al.

[11] Patent Number: 5,033,148

[45] Date of Patent: Jul. 23, 1991

[54] APPARATUS FOR CLEANING A SURFACE SUBMERGED IN A LIQUID

[75] Inventors: Daniel J. V. D. Chauvier, 17037 Royal Palm Cove, Polo Club, Boca Raton, Fla. 33496; Peter Woodman, Springs, South Africa

[73] Assignee: Daniel J. V. D. Chauvier, Boca Raton, Fla.

[21] Appl. No.: 419,907

[22] Filed: Oct. 11, 1989

[30] Foreign Application Priority Data

Oct. 12, 1988 [ZA] South Africa ..... 88/7603

[51] Int. Cl.[5] ..... E04H 3/20

[52] U.S. Cl. ..... 15/1.7; 15/404

[58] Field of Search ..... 15/1.7, 404

[56] References Cited

U.S. PATENT DOCUMENTS 4,023,227 5/1977 Chauvier ..... 15/1.7

4,642,833 2/1987 Stoltz et al. ..... 15/1.7

4,761,848 8/1988 Hofmann ..... 15/1.7

*Primary Examiner*—Edward L. Roberts

*Attorney, Agent, or Firm*—Ladas & Parry

[57] ABSTRACT

A submersible automatic swimming pool cleaner (10) comprises a body (13) defining a flow passage (14) extending between an inlet (15) thereto and an outlet (16) therefrom. An auxiliary inlet (15) to the passage is also defined in body (13). A flap (19) is mounted in inlet (18) and is pivotal between a first position, wherein the auxiliary inlet (18) is open and wherein part of the flap extends into passage (14) to form a constriction to liquid flow through the passage, and a second position, wherein the auxiliary inlet (18) is closed and the constriction is removed. In use, the flap (19) oscillates between the first and second positions thereby causing water flow through the cleaner intermittently to be varied. In this way kinetic energy is imparted to the cleaner to cause it to move over a surface (12) to be cleaned, while sucking debris from the surface.

10 Claims, 2 Drawing Sheets

APPARATUS FOR CLEANING A SURFACE SUBMERGED IN A LIQUID

This invention relates to automatic swimming pool cleaners. More particularly the invention relates to submersible suction cleaners of the kind adapted to be connected to a suction source and to utilise variations in water flow through the cleaner to impart kinetic energy to the cleaner thereby to cause it to move over the surface to be cleaned.

It is an object of the invention to provide alternative apparatus of the aforementioned kind.

According to the invention apparatus for cleaning a surface submerged in a liquid comprises:

a body defining a first flow passage extending between a first inlet to the passage and an outlet therefrom; the inlet, in use, being in communication with the surface to be cleaned and the outlet being connected to a suction source;

an auxiliary inlet to the passage; the auxiliary inlet being defined in an outside wall of the body between the first inlet and the outlet; and liquid flow varying means moveably mounted on the body in a region close to the auxiliary inlet;

the liquid flow varying means being adapted, under the influence of liquid flow past it to move between a first position relative to the body wherein the auxiliary inlet is open and wherein at least part of the liquid flow varying means extends into the first flow passage to form a constriction to liquid flow in that passage and a second position wherein the auxiliary opening is substantially closed and the constriction in the first flow passage is substantially removed, thereby intermittently to vary liquid flow through the cleaner towards the outlet and to impart kinetic energy to the cleaner to cause the cleaner to move over the surface whilst sucking debris from the surface.

It will be appreciated that with the liquid flow varying means moving repeatedly and alternately into and out of the first flow passage liquid flow through that passage is repeatedly and alternately varied. Furthermore, liquid flow through a second flow passage extending between the auxiliary opening and the outlet is also repeatedly and alternately varied by the said means.

The first and second flow passages may have suitable cross-sectional areas and may be of a suitable length dependent inter alia on the suction pressure applied to the passages such that liquid flowing through the passages has sufficient kinetic energy so that when the flow of liquid through the apparatus is decreased, sufficient energy is transferred to the apparatus to displace it along the surface to be cleaned.

The liquid flow varying means may comprise a rigid flap pivotably mounted on the body to move between the said first and second positions.

In the preferred embodiment the flap is mounted in the auxiliary inlet to pivot about an axis located between opposed peripheral regions of the flap.

The said opposed peripheral regions of the flap may have airfoil-like profiles. In the preferred embodiment the airfoil-like profile on one side of the axis is the inverse of the profile on the other side thereof.

The peripheral regions of the body defining the auxiliary inlet may also have airfoil-like profiles. In the preferred embodiment the said peripheral regions of the body have airfoil-like profiles inversely to that of the peripheral regions of the flap facing them.

The flap may be biased towards its first position. Any suitable means of so biasing the flap may be provided. So, for example, may it be spring biased towards the first position, alternately it may be biased towards that position by gravity.

Movement of the flap may be limited by a stop member provided on the body and adapted to stop the flap at its first and second positions.

Further according to the invention the size of the first inlet may be adjustable. Liquid flow through this inlet and hence also the first flow passage may thus be varied to optimise the effectivity of the device for a particular application.

The first inlet may communicate with a mouth defined in a peripheral region of the body and which region is releasably engageable with the surface to be cleaned. This region may be planar so that the apparatus is particularly suitable for cleaning planar surfaces. The axis of the first flow passage may be located at an angle of 45 degrees to the plane of the aforementioned region.

In order to cater for irregularities in the surface to be cleaned, to cater for curved transition zones between adjacent planar surfaces and to assist in the cleaning action, the apparatus may have a sealing flange of flexible material about the region defining the mouth. This flange may be rotatably mounted on the body. Since the suction grip of the body on the surface is increased by such a flange, a relief opening may be provided in the body in a region thereof on the opposite side of the flange as the mouth.

The cleaning apparatus may be partly or entirely of a mouldable synthetic plastic material.

The apparatus may be particularly adapted to clean the walls and the floors of a swimming pool. The suction pressure may then be exerted by a conventional pump utilised with the swimming pool and the water sucked through the apparatus is cleaned by the associated filter of the swimming pool.

The invention will now be described further, by way of example only, with reference to the accompanying diagrams wherein.

Figure 1:
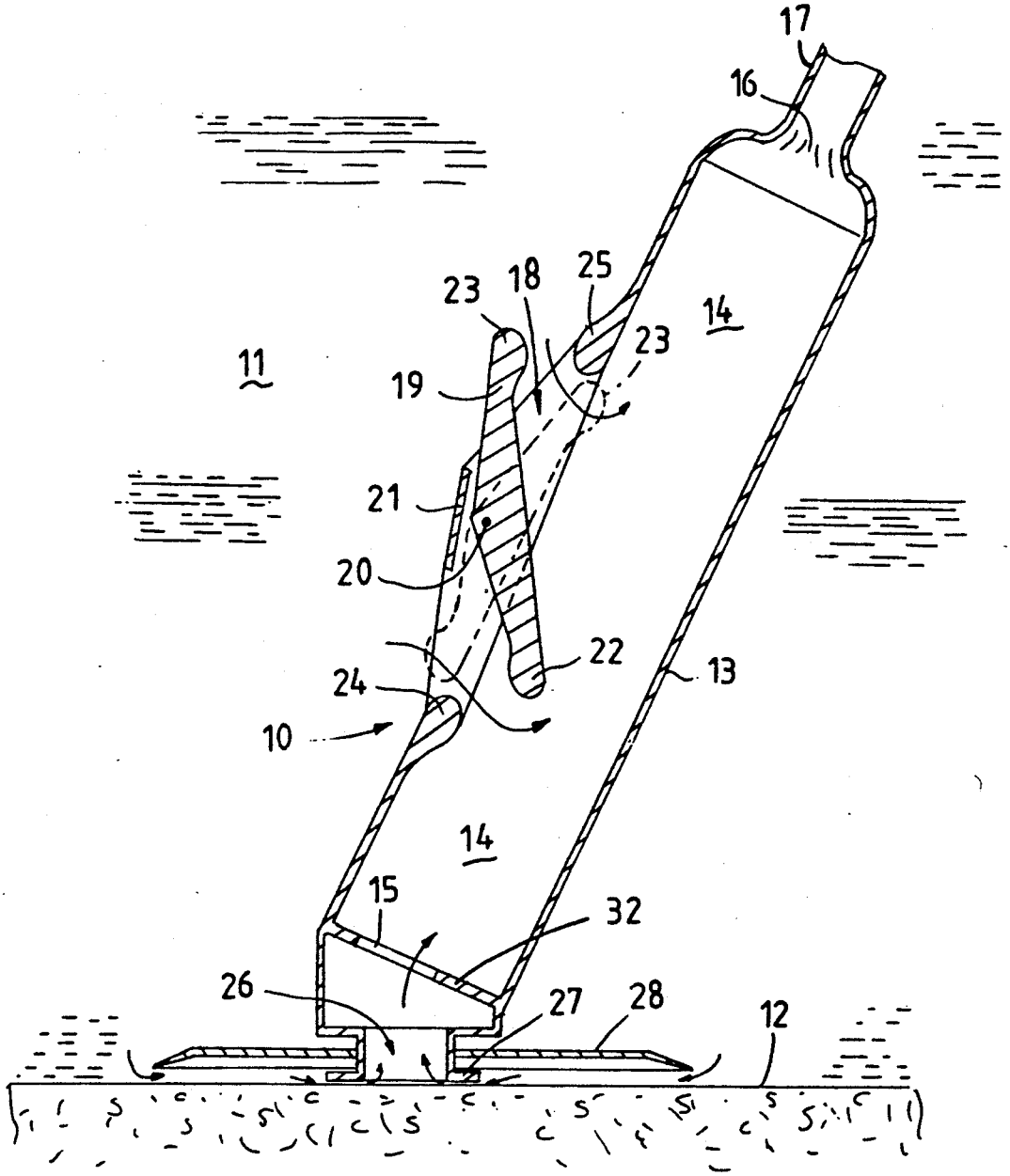
FIG. 1 is a schematic, longitudinal sectional view of a preferred embodiment of an apparatus according to the invention in the form of a submersible automatic swimming pool cleaner.

In FIG. 1 the cleaner according to the invention is generally designated by the reference numeral 10 and is shown submerged in the water 11 of a swimming pool. The cleaner, in use, serves to clean the floor 12 and walls of the pool.

The apparatus 10 comprises a generally tubular body 13 defining a circular first flow passage 14 extending between a first, off-centre inlet 15 in a transverse wall 32 and an outlet 16. The outlet 16 is adapted to be connected to a suction source or pump (not shown) forming part of the swimming pool's filtration system (also not shown) by a flexible suction hose 17.

In an outside wall of the body 13 and between inlet 15 and outlet 16, there is defined an auxiliary inlet 18. Liquid flow varying means in the form of a flap 19 is mounted on body 13 to pivot about axis 20. The flap 19 is adapted under the influence of water flow past it, to move, in see-saw fashion, between a first position (shown in solid lines in the diagram) wherein the auxiliary inlet 18 is open and wherein at least part of flap 19 extends into flow passage 14 to form a constriction to water flow in that passage and a second position (shown in broken lines in the drawing) wherein the auxiliary inlet 18 is substantially closed and the first flow passage 14 is substantially clear. The effective (open) size of the inlet 15 is adjustable, e.g. can be restricted with an apertured grommet 30, for example, so that water flow through the first flow passage may be adjusted to optimise the effectivity of the apparatus for a particular application.

A stop member 21, is mounted on body 13 to limit the movement of the flap 19 between its aforementioned first and second positions.

Figure 2:
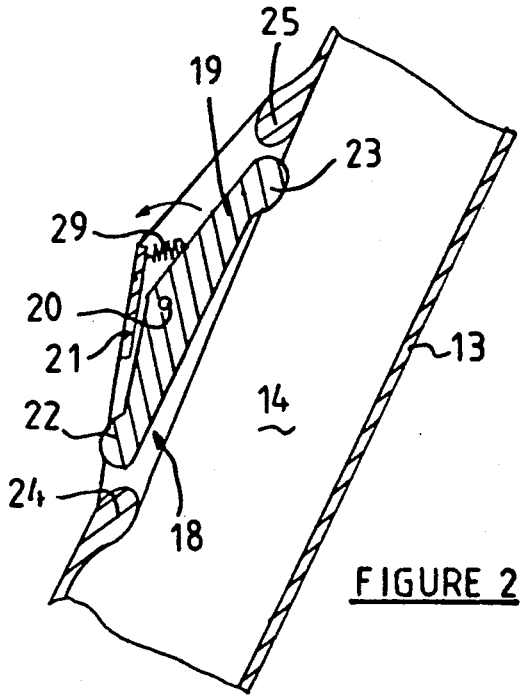
FIG. 2 is an enlarged sectional view of a region defining an auxiliary inlet of another embodiment of the apparatus.
Figure 3:
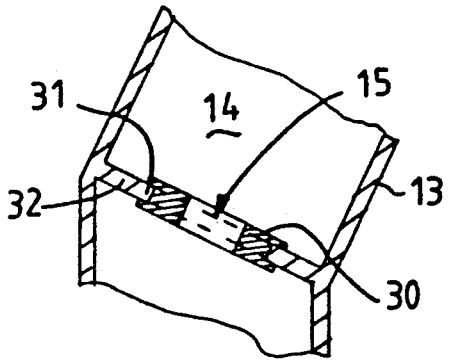
FIG. 3 is an enlarged sectional view of a region defining a first inlet.

The flap 19 is biased towards its first position by a spring 29 (FIG. 2).

As can be seen in FIGS. 1 and 2, the periphery 22 of flap 19 on the one side of axis 20 towards inlet 15 has an airfoil-like profile. Furthermore, the periphery 23 of flap 19 on the other side of the axis has a similar, but inverted profile.

The peripheral regions 24 and 25 of the body defining auxiliary inlet 18 also have airfoil-like profiles. The profile of region 24 is the inverse of region 22, while the profile of region 25 is the inverse of that of region 23.

First inlet 15 communicates with the exterior through a mouth 26 defined in the body 13 in a peripheral region 27 thereof. Peripheral region 27 is releasably engageable with floor 12 to be cleaned. The region 27 is furthermore planar so that the apparatus 10 is particularly suitable for cleaning planar surfaces. The longitudinal axis of the first flow passage 14 is located at an angle of approximately 45 degrees to the plane of the aforementioned region 27.

A sealing flange 28 of a resiliently flexible material is mounted about mouth 26.

In use, when the apparatus 10 is submerged in the water 11 of the swimming pool and connected to the suction pump as hereinbefore described, water will be sucked through mouth 26, inlet 15 and first flow passage 14 towards outlet 16. With flap 19 biased towards its first position, water will also be sucked through auxiliary inlet 18 towards outlet 16.

It will be appreciated that with water flowing through open auxiliary inlet 18 past flap 19, a region of relatively lower pressure is created above flap 19 on the one side of axis 20 and a similar region of relatively lower pressure is created below flap 19 on the other side of axis 20. These regions of relatively lower pressure will cause the flap 19 to move from its first position to its second position.

The flow of water past flap 19 creates regions of relatively lower pressure as described hereinbefore causing the flap 19 to move towards its second position where it is stopped by stop member 21. Under the influence of liquid flow through substantially closed inlet 18 and its bias, the flap 19 will then return to its normal, first position. In this manner flap 19 oscillates in see-saw fashion between its first and second positions.

It will be appreciated that with the region of flap 19 facing inlet 15 moving into and out of flow passage 14, the flow of water through that passage is intermittently and repeatedly varied, thereby causing kinetic energy to be imparted to the body 13, to cause the cleaner 10 to move in step-wise manner over floor 12. It will further be appreciated that as flow through passage 14 is never cut-off completely, there is continuous flow of water through the hose 17 thereby reducing jerking in hose 17 when compared to similar hoses when connected to known cleaners wherein liquid flow is intermittently interrupted.

It will further be appreciated that many variations in detail on the cleaning apparatus according to the invention are possible without departing from the scope and spirit of the appended claims.

We claim:

1. Apparatus for cleaning a surface submerged in a liquid comprising:

a body defining a first flow passage extending between a first inlet to the passage and an outlet therefrom; the inlet, in use, being in communication with the surface to be cleaned and the outlet being connected to a suction source;

an auxiliary inlet to the passage; the auxiliary inlet being defined in an outside wall of the body between the first inlet and the outlet; and liquid flow varying means moveably mounted on the body in a region close to the auxiliary inlet;

the liquid flow varying means being movable under the influence of liquid flow past it between a first position relative to the body wherein the auxiliary inlet is open and wherein at least part of the liquid flow varying means extends into the first flow passage to form a constriction to liquid flow in that passage and a second position wherein the auxiliary inlet is substantially closed and the constriction in the first flow passage is substantially removed, thereby intermittently to vary liquid flow through the cleaner towards the outlet and to impart kinetic energy to the cleaner to cause the cleaner to move over the surface whilst sucking debris from the surface.

2. Apparatus as claimed in claim 1 wherein the liquid flow varying means comprises a rigid flap pivotably mounted on the body for the movement between the first and second positions.

3. Apparatus as claimed in claim 2 wherein the first inlet is off center in a wall transverse to the outside wall.

4. Apparatus as claimed in claim 3 wherein the said peripheral regions of the flap have airfoil-like profiles.

5. Apparatus as claimed in claim 4 wherein the airfoil-like profile on one side of the axis is the inverse of the profile on the other side thereof.

6. Apparatus as claimed in claim 4 wherein the outside wall of the body defining the auxiliary inlet also has airfoil-like profiles.

7. Apparatus as claimed in claim 6 wherein the airfoil-like profiles of the outside wall are inverse to airfoil-like profiles of peripheral regions of the flap that face the former.

8. Apparatus as claimed in claim 1 wherein the liquid flow varying means is biased towards its first position.

9. Apparatus as claimed in claim 1 wherein a stop member is provided on the body to limit movement of the liquid flow varying means between its first and second positions.

10. Apparatus as claimed in claim 1 wherein the size of the first inlet is adjustable.

* * * * *